US007918701B2

(12) United States Patent
Spinoza

(10) Patent No.: US 7,918,701 B2
(45) Date of Patent: Apr. 5, 2011

(54) BUOYANCY AND RESCUE DEVICE

(76) Inventor: Marc Spinoza, London (GB)

( * ) Notice: Subject to any disclaimer, the term of this patent is extended or adjusted under 35 U.S.C. 154(b) by 194 days.

(21) Appl. No.: 12/067,800

(22) PCT Filed: Sep. 22, 2006

(86) PCT No.: PCT/GB2006/003509

§ 371 (c)(1),
(2), (4) Date: Mar. 21, 2008

(87) PCT Pub. No.: WO2007/034189

PCT Pub. Date: Mar. 29, 2007

(65) Prior Publication Data

US 2008/0254694 A1 Oct. 16, 2008

(30) Foreign Application Priority Data

Sep. 22, 2005 (GB) ..... 0519383.4

(51) Int. Cl.
*B63C 9/08* (2006.01)

(52) U.S. Cl. ..... 441/108; 441/113; 441/122

(58) Field of Classification Search ..... 441/108, 441/113, 122
See application file for complete search history.

(56) References Cited

U.S. PATENT DOCUMENTS

| | | | | |
|---|---|---|---|---|
| 4,804,326 | A | 2/1989 | Lennon | |
| 4,862,922 | A * | 9/1989 | Kite, III | 138/119 |
| 5,038,663 | A | 8/1991 | Plummer | |
| 6,926,570 | B1 | 8/2005 | Cortez et al. | |

FOREIGN PATENT DOCUMENTS

| | | |
|---|---|---|
| FR | 2772713 | 6/1999 |
| GB | 272769 | 11/1926 |

OTHER PUBLICATIONS

Great Britain Search Report for GB0519383.4 dated Nov. 17, 2005.

* cited by examiner

*Primary Examiner* — Stephen Avila
(74) *Attorney, Agent, or Firm* — Chalker Flores, LLP; Daniel J. Chalker; Edwin S. Flores

(57) ABSTRACT

There is described herein an apparatus for providing buoyancy and/or facilitating rescue of a person or object. The apparatus includes a tubular sleeve for securing the apparatus around at least a portion of a person or an object wherein longitudinal extension of the sleeve causes the diameter of the sleeve to contract radially to grip the person or object or a portion thereof and wherein longitudinal compression of the sleeve causes the diameter of the sleeve to expand. The apparatus may further include a structure coupled to the tubular sleeve for attaching the apparatus to rescue equipment and/or for providing a handle and/or at least one flotation device coupled to the tubular sleeve.

19 Claims, 8 Drawing Sheets

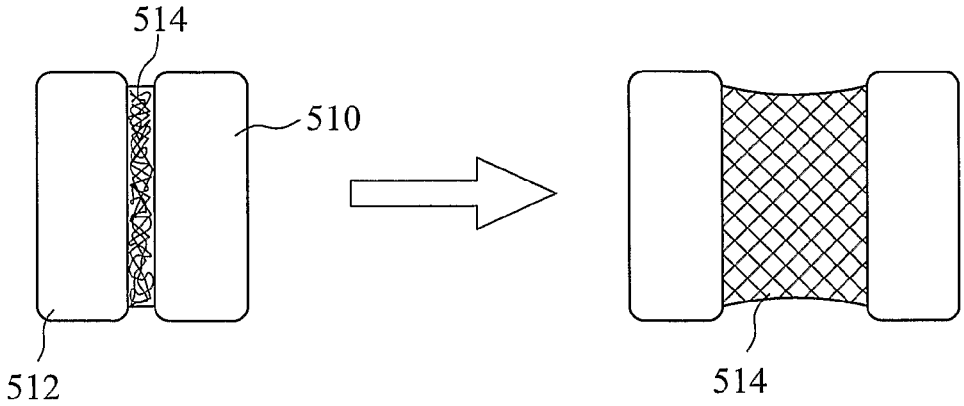
Fig. 5A
Fig. 5B
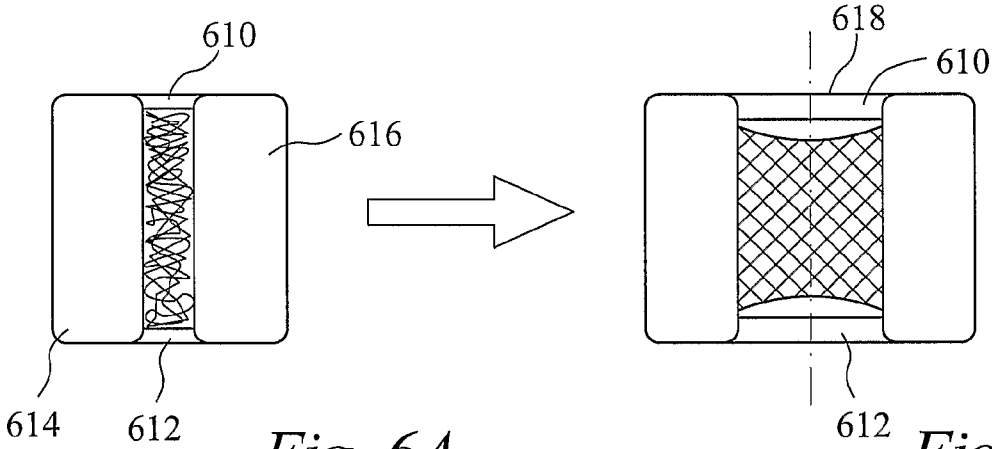
Fig. 6A
Fig. 6B
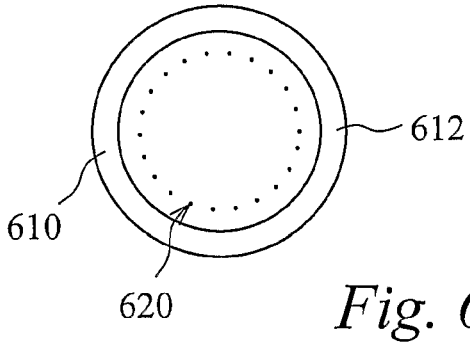
Fig. 6C

BUOYANCY AND RESCUE DEVICE

FIELD OF THE INVENTION

The present invention relates to the field of buoyancy and rescue devices and, in particular, to buoyancy aids, for example used as swimming aids or life preservation and rescue devices.

BACKGROUND OF THE INVENTION

There are many situations in which it is desirable to provide buoyancy to a person or an object. In particular, secure buoyancy is paramount to confidence and survival in swimming. Weak swimmers, or those learning to swim may use buoyancy aids to assist them in swimming and buoyancy aids can save the lives of those in difficulty in water.

Prior art buoyancy aids rely on inflatable devices such as armband, which grip as they are inflated, or solid foam rings, which are placed over the arms and grip by virtue of a soft collar. Other flotation systems may incorporate foam-filled jackets, inflated harnesses, or a more conventional solid flotation typical of life belts seen by most areas of water considered to be hazardous.

One problem faced by the person or object being supported is that swimmers and wet objects are slippery and, to give effective buoyancy, the device must not deflate, come off or move position. Inflatable devices only tend to grip securely when they are fully inflated, so air leaks are a serious threat to their function. Further, inflatable buoyancy aids must be inflated before use so valuable time may be lost in an emergency situation in deploying the device. Solid foam devices must fit securely to be of any use. In particular, in the case of babies, infants and small children, the foam-filled jackets that are used are often too easily pulled over the person in them unless they fit snugly. Inflatable harnesses are also often unsafe since they can easily upturn, leaving the person upside-down, face down in the water.

The time taken for a weak swimmer or a swimmer in difficulty to panic, especially in a watery environment, is short and the situation can rapidly deteriorate, producing a potentially avoidable disaster.

SUMMARY OF THE INVENTION

According to an aspect of the invention, there is provided apparatus for the increased buoyancy and/or rescue of a person or object, the apparatus comprising:

a tubular sleeve for securing the apparatus around at least a portion of a person or an object; wherein longitudinal extension of the sleeve causes the diameter of the sleeve to contract radially to grip the person or object or a portion thereof and wherein longitudinal compression of the sleeve causes the diameter of the sleeve to expand.

Due to the tubular sleeve construction of the apparatus, the rescue and/or buoyancy apparatus may be deployed rapidly and safely to a user or object.

Since the diameter of the sleeve is variable, it may be applied to a range of objects or a range of sizes of user to provide a universal fit. As the apparatus is fitted around the user or object, the sleeve contracts radially to provide a secure fit around the user or object, whatever their size within a predetermined range.

The apparatus may be provided in a number of different sizes, however, to allow the diameter of the sleeve and the size of the apparatus to be matched to the size of the user or object for which it is intended to be used. For example, buoyancy apparatus designed for children may be provided in a number of different sizes to ensure that the appropriate size of apparatus fits securely around a young infant and that a different size of apparatus fits securely around an older child.

The radially expanding and contracting sleeve of the apparatus also provides for rapid fitting, adjustment and removal of the apparatus. The apparatus may be applied, adjusted or removed simply by compressing the sleeve longitudinally to allow it to expand radially and release the user or object. Preferably, on application of the apparatus, the sleeve automatically extends longitudinally and contracts radially to grip the user or object, that is the sleeve is preferably biased to a lengthened position.

The apparatus may provide a simple, cheap and effective way of providing a secure and effective flotation and/or rescue device.

It is noted that the references to 'user' herein extend to a human or animal or other living user.

A further advantage of the tubular sleeve construction is that the sleeve can apply an even radial pressure to an object or user, so that the object or user can be gripped securely without pinching, hurting or crushing the user or object. Hence a larger gripping force may be applied to the user or object than would be possible without the tubular sleeve.

Preferably, the apparatus further comprises at least one of:

attachment means coupled to the tubular sleeve for providing a handle and/or attaching the apparatus to rescue equipment; and at least one flotation means coupled to the tubular sleeve.

Hence the apparatus may be used either as a rescue device or a buoyancy aid, or as a combination of the two.

According to a further embodiment, there is provided apparatus for providing buoyancy to a person or object, the apparatus comprising:

a tubular sleeve for securing the apparatus around at least a portion of the person or object, wherein longitudinal extension of the sleeve causes the diameter of the sleeve to contract radially to grip the person or object or a portion thereof and wherein longitudinal compression of the sleeve causes the diameter of the sleeve to expand radially;

at least one flotation means coupled to the tubular sleeve.

As set out above, the design of the tubular sleeve may provide a fast, efficient and secure means for attaching the flotation means to a user or an object.

In one embodiment, the apparatus may further comprise attachment means for providing a handle and/or securing the apparatus to another object. In particular, the apparatus may further comprise attachment means coupled to the tubular sleeve for attaching the apparatus to rescue equipment. A handle may be used to allow a third party, such as a rescuer or parent of a child wearing the apparatus to control the person or object within the apparatus. For example, if the apparatus is used as a buoyancy aid for a child, attachment means in the form of a handle, may be provided on the apparatus to allow a parent to hold onto the child (either directly or via a tether) and to lift the child out of the water when necessary.

According to a further aspect, there is provided apparatus for the rescue of a person or object, the apparatus comprising:

a tubular sleeve for securing the apparatus around at least a portion of a person or an object, wherein longitudinal extension of the sleeve causes the diameter of the sleeve to contract radially to grip the person or object or a portion thereof and wherein longitudinal compression of the sleeve causes the diameter of the sleeve to expand radially;

attachment means coupled to the tubular sleeve for providing a handle and/or attaching the apparatus to rescue equipment.

As set out above, the tubular sleeve may enable the user or object to be gripped tightly and securely but without crushing or hurting the user or object.

The apparatus may be designed to grip the user tightly enough and provide enough strength to be used in a full air-sea rescue system. That is, the apparatus may be capable of lifting a fully-grown adult without becoming detached from the user or breaking.

In a preferred embodiment, the rescue apparatus further comprises flotation means. Hence the rescue device may provide both buoyancy and a rescue means to the user.

Preferably, the tubular sleeve is braided. The braided sleeve may comprise a plurality of woven filaments, preferably woven in spirals having opposing directions so that a diagonal weave is provided in the walls of the tubular sleeve.

In one embodiment, the apparatus comprises an armband. Hence the tubular sleeve may be deployed around an arm of the user. Preferably, the armband is used in a pair of armbands.

In an alternative embodiment, the apparatus comprises a lifebelt. In this embodiment, the tubular sleeve may be deployed around the torso or waist of the user.

In one embodiment, the flotation means comprises a foamed material. In an alternative embodiment, or in addition to the foamed material, the flotation means comprises at least one air chamber. In one embodiment, the apparatus may comprise flotation means attached at each end of the tubular sleeve. Alternatively, or in addition, flotation means, such as an air chamber, may be provided along the length of the sleeve, between the sleeve ends.

Any type of flotation means or buoyancy aid may be attached to the tubular sleeve to provide buoyancy for a user.

If an air chamber is used, the air chamber may be arranged to expand automatically and fill with air on deployment of the apparatus. That is, the air chamber may fill with air automatically as the length of the tubular sleeve expands.

Preferably, the air chamber comprises a one-way valve to allow intake of air. Hence the air chamber may expand easily to take in air but the one-way valve may prevent the expulsion of air from the chamber until the air is purposefully released.

In one embodiment, the tubular sleeve may be of a size suitable for placing over the arm of a user.

In an alternative embodiment, the tubular sleeve may be of a size suitable for placing over the torso of a user.

According to a further embodiment, there is provided apparatus according to any preceding claim further comprising at least one of: at least one light; at least one radio transmitter. The light and/or transmitter may be used by rescue services to locate and rescue users as described in more detail below.

The at least one light and/or radio transmitter may be arranged to operate automatically on deployment of the apparatus.

In one embodiment, at least one flotation means is provided at each end of the tubular sleeve.

The tubular sleeve may also be provided with end portions, for example collars, at each end of the tubular sleeve.

Alternatively, or in addition, at least one flotation means is provided over a central portion of the tubular sleeve, between the end portions. The flotation means may be free to move over the central portion of the tubular sleeve, between the end portions, or may be fixed relative to the tubular sleeve.

In a further embodiment, at least one flotation means may be formed integrally with the tubular sleeve, for example in the end portions.

In a further embodiment, the tubular sleeve may itself provide buoyancy.

In one embodiment the flotation means may comprise one or more float elements, for example portions or foam, detachably coupled to the tubular sleeve. This may allow the removal or addition or float elements to the tubular sleeve, to provide different amounts of buoyancy of different designs of float elements.

In one embodiment, the tubular sleeve may comprise a waterproof layer, covering or coating. This may allow the person or object within the apparatus to be kept dry.

Methods of deploying and using apparatus as described herein may further be provided.

BRIEF DESCRIPTION OF THE DRAWINGS

Embodiments will now be described in more detail with reference to the drawings in which:

FIG. 5*a* illustrates one embodiment of a braided armband system in a compressed configuration;

FIG. 5*b* illustrates the braided armband system of FIG. 5*a* in an extended configuration;

FIG. 6*a* illustrates a further embodiment of a braided armband system, including an automatic air-filled buoyancy system;

FIG. 6*b* illustrates the braided armband system of FIG. 6*a* in an extended configuration;

FIG. 6*c* is a cross-sectional view of the system of FIG. 6*a* in an extended configuration;

DETAILED DESCRIPTION OF THE INVENTION

Figure 1:
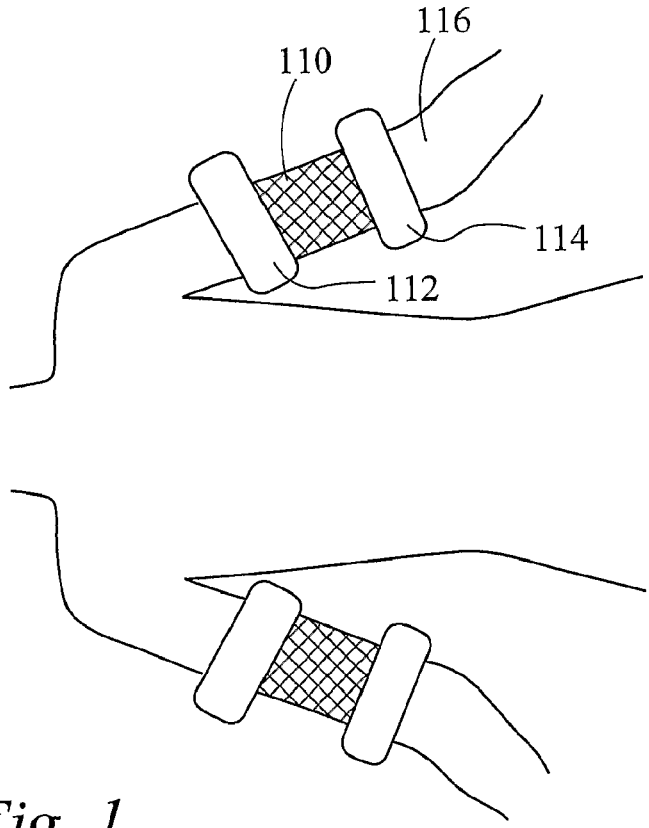
FIG. 1 illustrates an embodiment of the braided armband system.

An embodiment of a pair of armbands, which may be used as a swimming aid, will now be described with reference to FIG. 1. Each armband comprises a tubular braided sleeve 110 which has a flotation means or float 112, 114 attached at each end. The floats 112, 114 may comprise foam floats or inflated air compartments or a mixture of the two. The braided sleeve 110 of the embodiment has a woven structure and is formed as a tube. The floats 112, 114 are attached at each end of the tube so as to maintain the aperture at each end of the tube. As the sleeve 110 is compressed longitudinally, the internal diameter of the tubular sleeve expands. This enables the sleeve 110 to be placed over an arm 116 of the user. As the sleeve is released it expands longitudinally and the internal diameter of the sleeve contracts. This grips the arm of the user within the sleeve 110, holding the armband securely in position around the user's arm 116.

It will be appreciated by one skilled in the art that the floats 112, 114 attached to each end of the sleeve 110 may comprise any conventional type of float. For example, the floats 112, 114 may be foam floats, which may be formed from a foamed plastics material, or inflated floats, which may be inflated manually by the user or may inflate automatically, for example through a one-way valve, as the armband is released from packaging or a restraining device.

A number of different sizes of the armbands may be provided, for example for infants, children and adults but, it is noted that, due to the way in which the diameter of the sleeve portion expands and contracts to allow the user to insert their arm, a single size of armband may be used for a wide range of arm sizes. For a user with an arm of smaller diameter, the diameter of the sleeve will simply contract further to grip securely around the user's arm. Hence a single size of armband may attach securely to a wide range of arm diameters.

Figure 2:
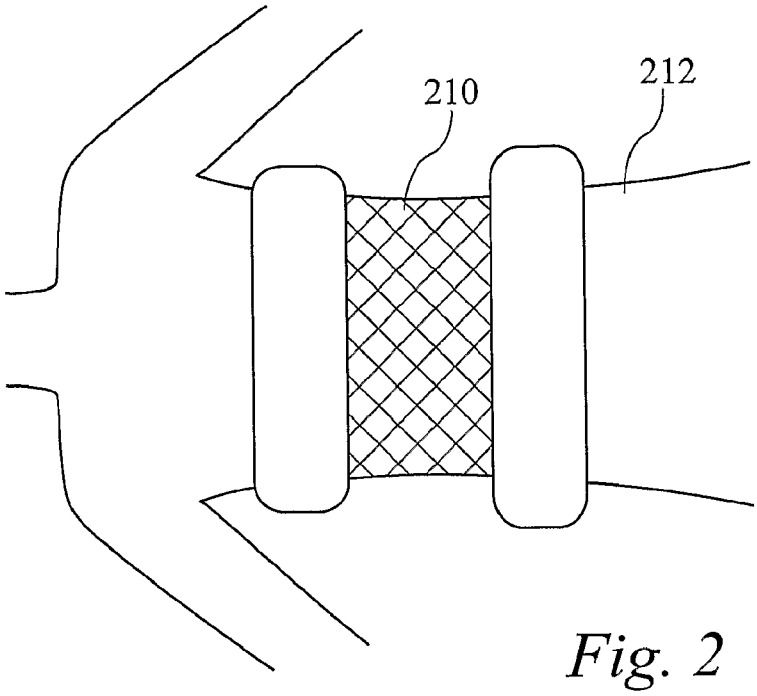
FIG. 2 illustrates one embodiment of the braided system incorporated into a life belt.

FIG. 2 illustrates a flotation device in the form of lifebelt according to one embodiment. The lifebelt has a similar construction to the armband described with reference to FIG. 1, but the diameter of the sleeve portion 210 is arranged to be large enough to fit around the torso of a user.

To deploy the lifebelt, the sleeve 210 is compressed longitudinally, allowing it to expand radially. The user then places the flotation device around their torso 212, either by stepping into the device or by bringing it over their head, and releases the flotation device, allowing the sleeve 210 to expand longitudinally and contract radially to grip the user around the torso 212.

In one embodiment, in either the armband or lifebelt system, the buoyancy of the float at the top of the flotation device may be greater than that at the bottom of the flotation device. This may mean that the user will float head-upwards by default, reducing the chance that the user will end up floating upside down in the water. In this embodiment, the float should be clearly marked to ensure that users do not put the float on upside down.

Figure 4:
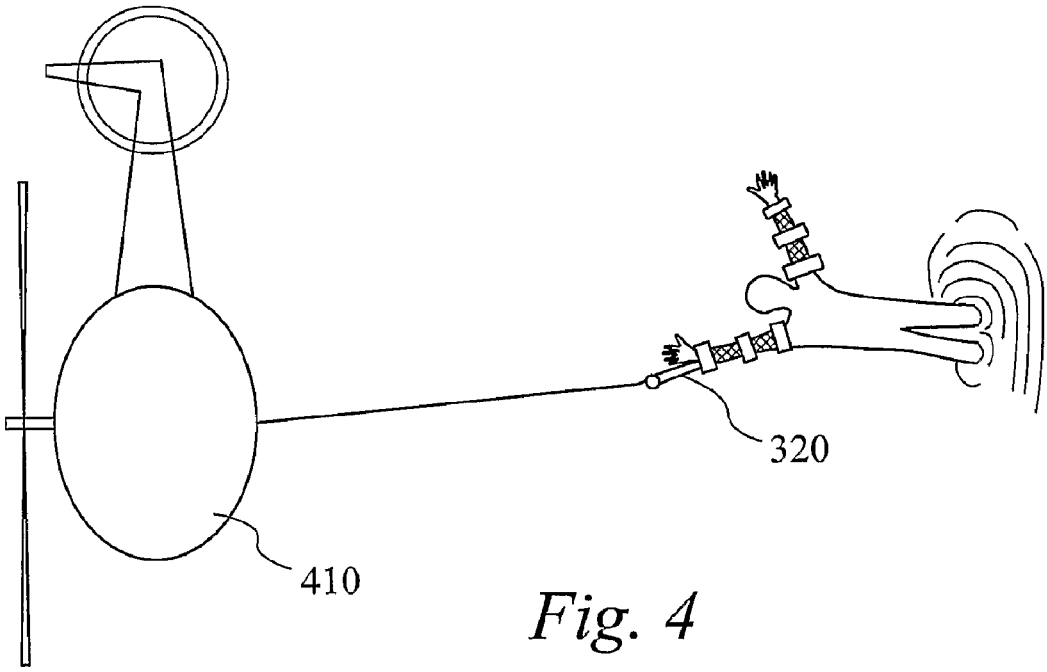
FIG. 4 illustrates schematically how the buoyancy system of FIG. 3 may be used in an air-sea rescue operation.
Figure 3:
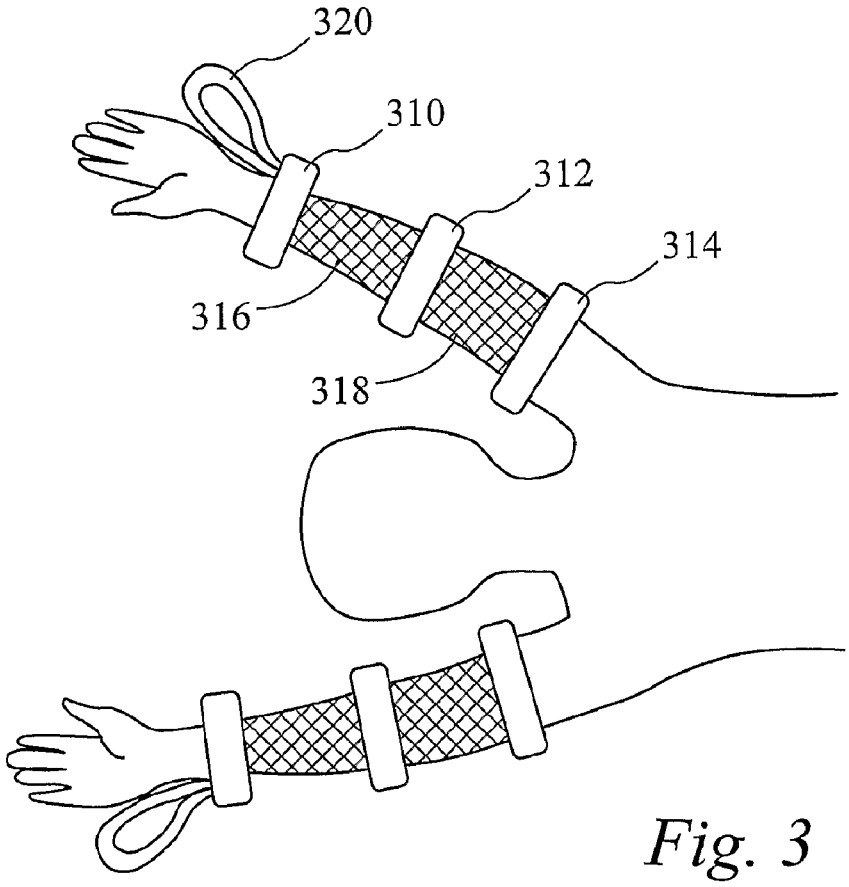
FIG. 3 is schematic diagram of an extended braid and armband system, which may be used as a buoyancy system and/or a means of securely attaching a person, for example in an air-sea rescue operation.

FIG. 3 illustrates a further embodiment of a buoyancy system, which includes three float portions 310, 312, 314, coupled by two braided sleeve portions 316, 318. This extended armband may provide both additional buoyancy and may be secured more tightly around the arm of the user. As illustrated in FIG. 3, the buoyancy system (or any buoyancy system described herein) may further include attachment means 320, in the present embodiment in the form of loops of material, such as rope. The attachment means 320 may enable the user to be secured to other objects via the buoyancy system. For example, as illustrated in FIG. 4, the attachment means 320 of the buoyancy system may enable a user to be attached to a rescue device, such as a helicopter 410 used in air-sea rescue. An armband or lifebelt device such as those described herein may be particularly suited for use in a rescue situation since, as a tension force is applied at one end of the device to rescue the user by pulling the user away from the dangerous situation, the sleeve 316, 318 expands longitudinally and contracts further around the user, holding the user more securely. However, since the sleeve contracts radially and evenly, the grip applied to the arm of the user is applied over the whole of the surface of the user's arm or torso with an even pressure, providing a more comfortable experience for the user.

It will be appreciated that the rescue device described above may be deployed around one or both arms, the torso or any other part of a user's body. Further, the rescue device may be provided with either one or with more than one expanding sleeve, as illustrated in FIGS. 1 and 3 respectively.

In one embodiment, the sleeve may not be provided with flotation means, such as the floats described herein but may simply comprise a tubular sleeve with end pieces, such as collars. Such an embodiment preferably further includes attachment means for attaching the sleeve to other objects. Hence the device may be provided as a rescue device, such as that described above, without the flotation capabilities. This may be useful for people or equipment intended to be underwater, such as divers, who may wear the devices simply as rescue aids.

The attachment means may also be used for other purposes. For example, a diver or swimmer may use the attachment means to attach themselves via a length of rope to a boat, a pier, a buoy or to shore when swimming or diving in open water. This may enable the user to find their way back to safety or may enable the user to be found or hauled back in from the fixed point.

Similarly, the attachment means may be used as a handle to allow a parent to remove a child from water or to control the movements of the child.

In a further embodiment, the device may be used to attach equipment to users or to other equipment. For example, braided tubular sleeves may be provided, with or without flotation means, to secure equipment, such as flippers, camera equipment, maps, goggles, breathing equipment etc., to a user. In a specific embodiment, a braided tubular sleeve may be provided around a breathing tube. The sleeve may be attached, for example by a nylon thread, to a similar sleeve provided around the arm, for example around the wrist, of a user. In this way, the breathing tube can be easily located by the user, simply by following the line from their wrist.

The process of deploying a flotation or rescue device such as those described herein will now be described with reference to FIGS. 5*a* and 5*b*.

FIG. 5*a* illustrates a flotation device, including foam floats 510, 512, in a compressed configuration. The foam floats 510, 512 are shaped as rings and are coupled to each end of the tubular sleeve 514. The device may be held in the compressed configuration as shown, ready for deployment, for example by packaging or by restraining means, or may be compressed by the user before deployment. The user inserts part of their body, for example their arm or torso, into the aperture formed by the tubular sleeve 514 and the floats 510, 512 and the device is then released from the compressed configuration. On release, the device extends to an expanded configuration, as shown in FIG. 5*b*. Preferably, the device is biased to a lengthened position so that it springs open to the extended configuration on release. As the tubular sleeve 514 expands lengthways, the diameter of the sleeve contracts, gripping the user's body. The gripping force exerted by the sleeve on the user may be quite large but, since it is spread over the whole circumference of the sleeve, it is applied evenly over the user's body and does not discomfort the user at a particular point.

Further extension of the flotation device will cause the diameter of the tubular sleeve 514 to reduce further, gripping the user more tightly. For example, if a user tries to remove the device by pulling from one end or if movements in the water create tension in the device, the flotation device will simply become attached more securely to the user.

A further embodiment of a flotation device, such as an armband or a lifebelt is illustrated in FIGS. 6*a* to 6*c*. The embodiment illustrated includes one or more air pockets 610, 612 arranged between the float means 614, 616. The air pockets 610, 612 may simply comprise airtight chambers that include a one-way valve. Preferably, on expansion of the flotation device to the expanded configuration, as shown in FIG. 6*b*, the air pockets 610, 612 expand, automatically taking in air via the one-way valve. The expanded air pockets may then provide further buoyancy to the device user. Preferably an air-release mechanism 618 is provided to enable air to be released from the air pockets on compression of the device. In an alternative embodiment, air pockets may be provided that require manual inflation on expansion of the flotation device.

FIG. 6*c* is a cross-sectional view of the flotation device of FIGS. 6*a* and 6*b*. The diagram illustrates the air pockets 610, 612 which are formed between the floats and the filaments of the tubular sleeve 620. In an alternative embodiment, the air pockets 610, 612 may provide the only buoyancy for the flotation device and end-pieces may be provided rather than floats to provide end walls for the air pockets.

Figure 7A:
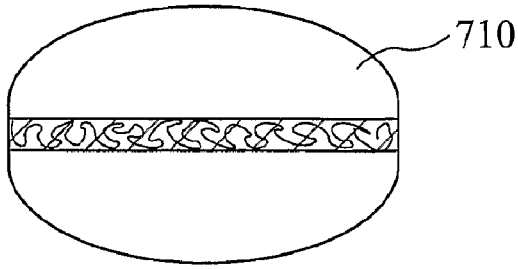
FIG. 7*a* is a schematic diagram of a lifebelt system in a compressed configuration.
Figure 7B:
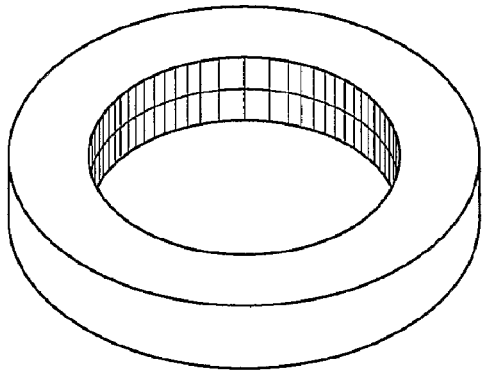
FIG. 7*b* is an oblique view of the lifebelt system of FIG. 7*a;*
Figure 7C:
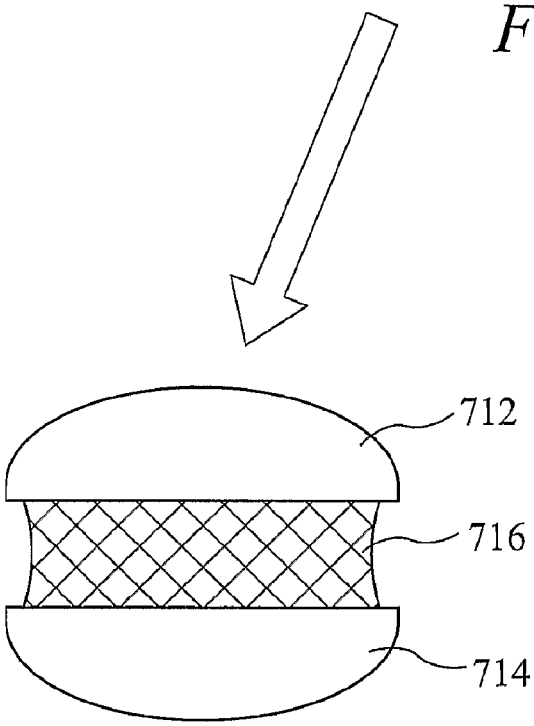
FIG. 7*c* illustrates the lifebelt system of FIG. 7*a* in an extended configuration.

FIGS. 7*a* to 7*c* illustrate a lifebelt system according to one embodiment. FIG. 7*a* illustrates the lifebelt 710 in a compressed configuration, ready for deployment. FIG. 7*b* is an oblique view of the compressed lifebelt. FIG. 7*c* illustrates the lifebelt system 712, 714, 716 in the extended, deployed configuration.

Figure 8A:
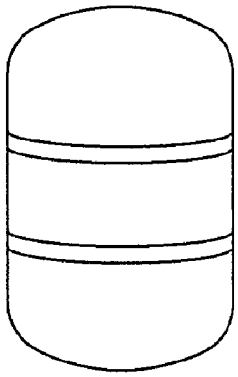
FIG. 8*a* is a schematic diagram of an extended armband system in a compressed configuration.
Figure 8B:
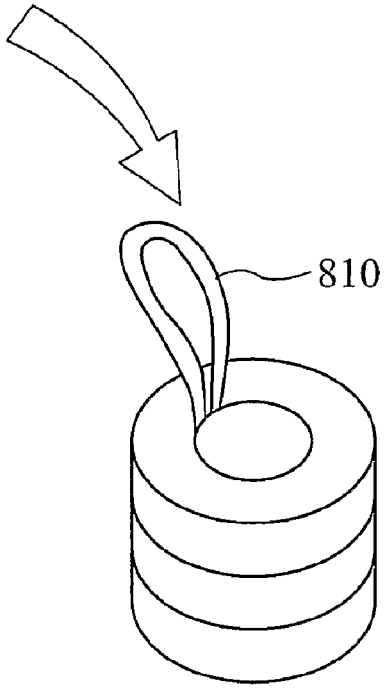
FIG. 8*b* is an oblique view of the armband system of FIG. 8*a*, including a safety loop for lifting the person using the system.
Figure 8C:
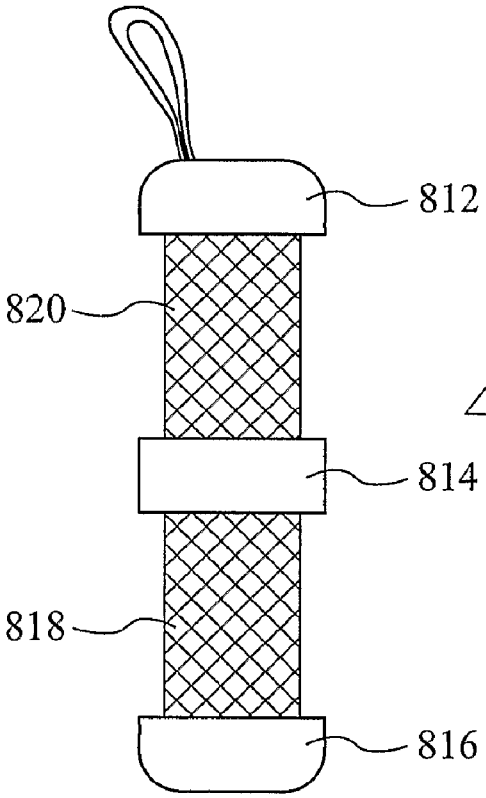
FIG. 8*c* illustrates the armband system of FIG. 8*a* in an extended configuration.

FIG. 8*a* is a schematic diagram of an extended armband system, such as that illustrated in FIGS. 3 and 4, in a compressed configuration. FIG. 8*b* is an oblique view of the armband system of FIG. 8*a*, including a safety loop 810 for securing the person using the system and FIG. 8*c* illustrates the armband system of FIG. 8*a* in an extended configuration, including three floats 812, 814, 816 and two sections of tubular sleeve 818, 820. It will be appreciated that the sections of tubular sleeve 818, 820 may be provided as two separate sleeve portions, or as a single continuous sleeve.

Figure 9A:
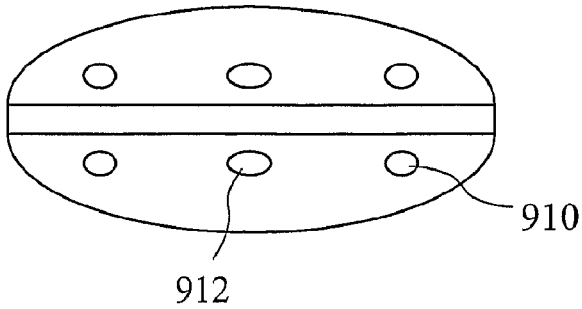
FIG. 9*a* is a schematic diagram of an embodiment of a lifebelt system, including lights and transmitters.
Figure 9B:
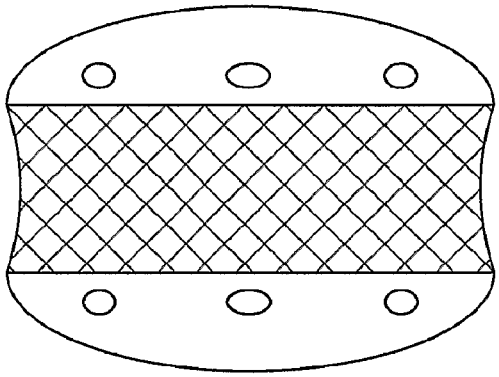
FIG. 9*b* illustrates the lifebelt system of FIG. 9*a* in an extended configuration.
Figure 9C:
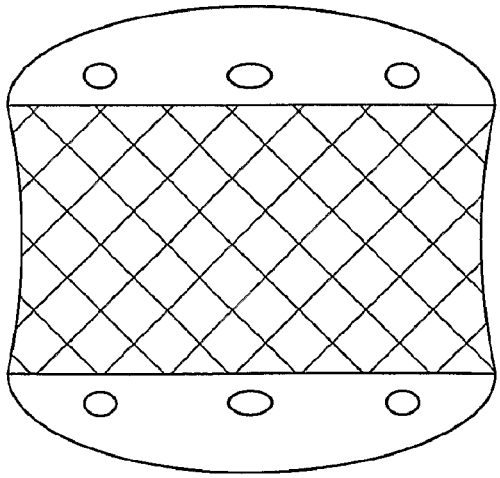
FIG. 9*c* illustrates the lifebelt system of FIG. 9*a* wherein the lights and transmitters have been activated.

FIGS. 9*a* to 9*c* illustrate a further embodiment of a lifebelt system including additional rescue means. In this case, the system includes lights 910, such as LEDs, and radio-frequency transmitters 912. This may assist rescue services in locating and rescuing stranded persons. As the lifebelt expands, as shown in FIG. 9*b*, for example by removing tape restricting the lifebelt, the additional rescue means 910, 912 may operate automatically, so the lights 910 may operate, for example by flashing, and the transmitters 912 may transmit a predetermined signal as the lifebelt expands. Alternatively, a switch may be provided by means of which the lights and/or transmitters may be jointly or individually operated.

In an alternative embodiment, lights and/or transmitters may be added to the flotation devices described herein as novelty features. For example, a child's armband may incorporate flashing lights that may operate via a switch or automatically on deployment of the armband.

Figure 11A:
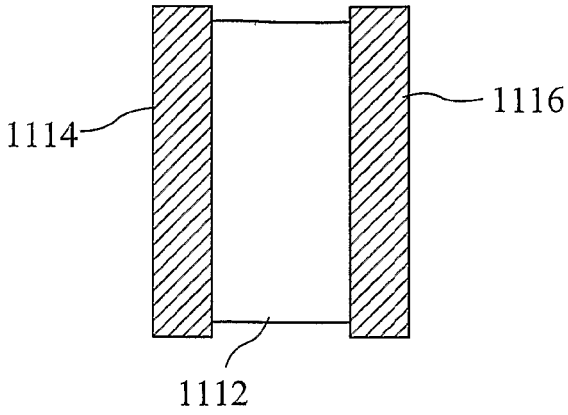
FIG. 11*a* illustrates a further embodiment of a flotation device in a compressed configuration.
Figure 11B:
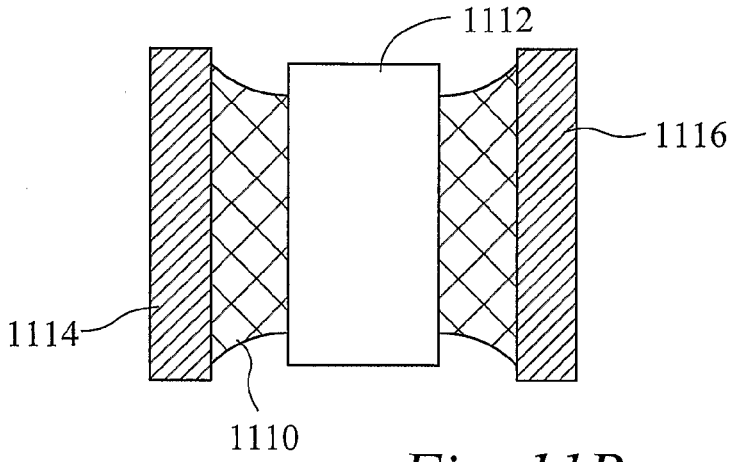
FIG. 11*b* illustrates the embodiment of FIG. 11*a* in an expanded configuration.
Figure 11C:
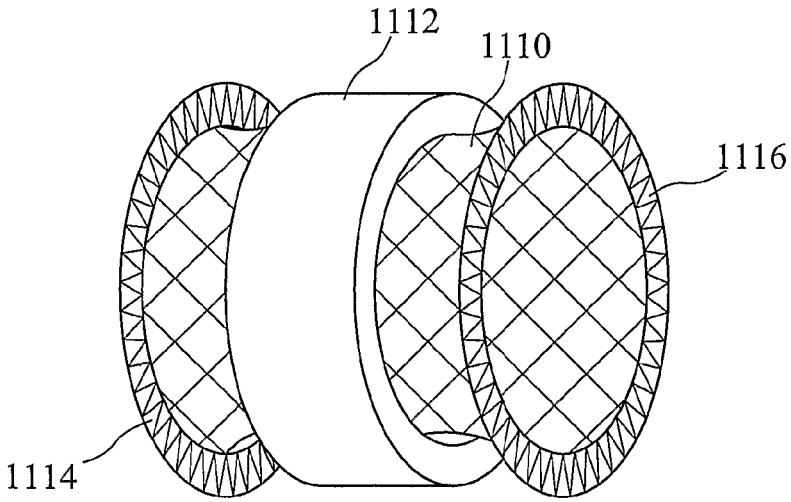
FIG. 11*c* is an oblique view of the embodiment of FIGS. 11*a* and 11*b*.

A further embodiment of a flotation device is illustrates in FIGS. 11*a* to 11*c*. The embodiment illustrated includes a braided tubular sleeve 1110 as described above, which may be deployed around a user's waist or arm. The device also includes at least one flotation means 1112 surrounding a portion of the tubular sleeve 1110. However, in this embodiment, the flotation means 1112 is provided towards the centre of the tubular sleeve 1110, rather than at one or more ends. The flotation means 1112 may be free to move along the length of the tubular sleeve 1110 or may be fixed in position relative to the tubular sleeve 1110, for example by a loosely-tied connection to the sleeve 1110.

The sleeve may further be provided with end-caps or collars 1114, 1116, which may or may not provide further buoyancy. In one embodiment, the collars 1114, 1116 may be formed from the end portions of the sleeve 1110. However, in another embodiment, the collars 1114, 1116 may be provided as separate components attached to the ends of the sleeve 1110. The collars 1114, 1116 may be elasticated but are preferably of a fixed diameter sufficient to allow a user's arm or torso to be inserted into the flotation device.

Figure 10A:
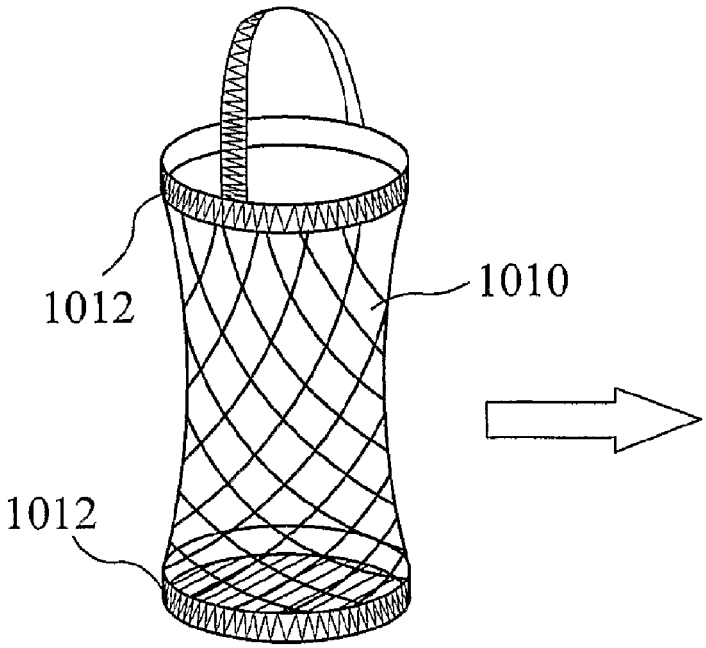
FIG. 10*a* illustrates a braided sack according to one embodiment, for containing and/or supporting items placed therein.
Figure 10B:
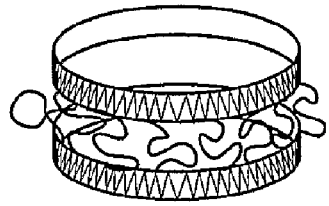
FIG. 10*b* illustrates the braided sack of FIG. 10*a* in a compressed configuration.

A further embodiment of a flotation device is illustrated in FIGS. 10*a* and 10*b*. The embodiment illustrated comprises a braided tubular sleeve 1010, capable of moving from a longitudinally-compressed configuration (FIG. 10*b*) to an extended configuration (FIG. 10*a*). The sleeve includes end-pieces 1012, at least one of which may comprise a float means, such as a foam-based or air-filled float. Hence, objects may be placed into the flotation device, within the tubular sleeve 1010, and may be held at the surface of the water by the float means.

In one embodiment, the tubular sleeve may comprise a waterproof covering, internal or external to the sleeve, to keep the contents of the device dry.

In a preferred embodiment, the tubular sleeve 1010 may be compressed longitudinally before an object is placed within the device. Longitudinal extension of the sleeve 1010 may cause the flotation device to grip the object, holding the object securely within the device.

In an alternative embodiment, the end pieces 1012 may be formed from or may comprise a material having a greater density than water. For example, metal weights may be incorporated into the end pieces 1012 to cause the device to sink. If an object is placed within the device and is gripped or trapped by the tubular sleeve 1010, this may cause the object to sink and to be held under the water.

It will be clear to one skilled in the art that a large number of other designs of the sack described above with reference to FIG. 10 may be provided, for example incorporating zips, lids and handles.

It will also be clear to one skilled in the art that variations and further features may be provided to the flotation devices described above. For example, the floats may be removable from the tubular sleeve, for example using a hook-and-loop system. Further, a plurality of removable floats may be provided for each tubular sleeve. This may allow floats to be interchanged, for example to provide different levels of buoyancy to the device or different sizes, shapes and colours of floats. If a plurality of different floats can be attached to a single flotation device, different levels of buoyancy may be provided to a single flotation device. This may be useful, for example, to allow a user to gradually reduce the buoyancy provided to a child who is learning to swim.

The tubular sleeve may be braided from a plastics material, such as nylon. In one embodiment, the tubular sleeve itself may provide buoyancy to the device. For example, the sleeve may be manufactured from a buoyant material or may be braided from a material that is itself tubular in form. In this embodiment, it may not be necessary to provide separate flotation means, or these may be detachable from the device. This may provide an unobtrusive flotation device which, for example, could be worn by weak swimmers who require only a small amount of buoyancy or as a cautionary device for users who are around water and may fall into water, but who are not specifically intending to swim.

In a further alternative embodiment, floats may be attached along the length of the tubular braid. For example, individual floats, such as pieces of foam, may be provided and may be attachable at points along the tubular sleeve. This may allow a user to design their own flotation device, both in terms of the look of the device and the level of buoyancy required.

The floats in the devices described above may have circular inner and outer profiles. However, in some embodiments, the float may be provided having a different shape. For example, floats shaped as an oval may more closely match a user's body shape around the torso or arm. Further, the inner aperture of the float may be shaped to match a user's body shape.

In the embodiments described above, to allow the flotation device to be packed as tightly as possible in its compressed state, the tubular braid may be attached not at the ends of the floats but within the aperture formed in the floats, for example at the centre point or outside edge of the inner circumference of the float. When the tubular braid is in a compressed state, this may allow the compressed tube to be stored within the aperture of the float, hence allowing the two floats to lie flush against each other. This may allow the device to be compressed as tightly as possible and to require the minimum amount of space when compressed for storage.

The invention claimed is:

1. An apparatus for providing buoyancy and/or facilitating rescue of a person or object, the apparatus comprising:

a tubular sleeve for securing the apparatus around at least a portion of a person or an object, wherein the tubular sleeve is biased to a longitudinally extended position such that releasing the tubular sleeve from a longitudinally compressed position to the longitudinally extended position causes the diameter of the tubular sleeve to contract radially to exert a compressive gripping force comprising an even radial pressure on the person or object or a portion thereof and longitudinal compression of the tubular sleeve from the longitudinally extended position to the compressed position causes the diameter of the tubular sleeve to expand radially to enable the person or object or a portion thereof to move relative to the sleeve, the tubular sleeve further comprising an aperture at each end of the tubular sleeve and an end portion at each end of the tubular sleeve for maintaining the aperture open at each end of the tubular sleeve.

2. The apparatus according to claim 1, further comprising at least one of:

attachment means coupled to the tubular sleeve for attaching the apparatus to rescue equipment and/or for providing a handle; and at least one flotation means coupled to the tubular sleeve.

3. An apparatus for providing buoyancy to a person or object, the apparatus comprising:

a first tubular flotation means;

a second tubular floatation means; and a tubular sleeve longitudinally disposed between the first tubular flotation means and the second tubular flotation means for securing the apparatus around at least a portion of the person or object, wherein longitudinal extension of the tubular sleeve causes the diameter of the tubular sleeve to contract radially to exert a compressive gripping force on the person or object or a portion thereof and wherein longitudinal compression of the tubular sleeve causes the diameter of the tubular sleeve to expand radially to enable the person or object or a portion thereof to move relative to the sleeve.

4. The apparatus according to claim 3 further comprising attachment means for providing a handle and/or for securing the apparatus to another object.

5. The apparatus according to claim 3 further comprising attachment means coupled to the tubular sleeve for attaching the apparatus to rescue equipment.

6. An apparatus for facilitating rescue of a person or object, the apparatus comprising:

a tubular sleeve for securing the apparatus around at least a portion of a person or an object, wherein the tubular sleeve is biased to a longitudinally extended position such that releasing the tubular sleeve from a longitudinally compressed position to the longitudinally extended position causes the diameter of the tubular sleeve to contract radially to exert a compressive gripping force on the person or object or a portion thereof and longitudinal compression of the tubular sleeve from the longitudinally extended position to the compressed position causes the diameter of the tubular sleeve to expand radially to enable the person or object or a portion thereof to move relative to the sleeve; and attachment means coupled to the tubular sleeve for providing a handle and/or attaching the apparatus to rescue equipment.

7. The apparatus according to claim 1 wherein the tubular sleeve is braided.

8. The apparatus according to claim 1 wherein the apparatus comprises a lifebelt.

9. The apparatus according to claim 2 wherein the flotation means comprises a foamed material.

10. The apparatus according to claim 2 wherein the flotation means comprises at least one air chamber.

11. The apparatus according to claim 10 wherein the air chamber expands automatically on deployment of the apparatus.

12. The apparatus according to claim 10 wherein the air chamber comprises a one-way valve to allow intake of air.

13. The apparatus according to claim 1 wherein at least one tubular flotation means is provided at each end of the tubular sleeve.

14. The apparatus according to claim 6 wherein the tubular sleeve is further provided with end portions at each end of the tubular sleeve.

15. The apparatus according to claim 2 wherein at least one tubular flotation means is provided over a central portion of the tubular sleeve, between the end portions.

16. The apparatus according to claim 2 wherein at least one tubular flotation means is formed integrally with the tubular sleeve.

17. The apparatus according to claim 2 wherein the flotation means comprises one or more float elements detachably coupled to the tubular sleeve.

18. The apparatus according to claim 1 wherein the tubular sleeve is of a size suitable for placing over the arm of a user.

19. The apparatus according to claim 1 wherein the tubular sleeve is of a size suitable for placing over the torso of a user.

* * * * *